US010923017B2

(12) United States Patent
Lin et al.

(10) Patent No.: US 10,923,017 B2
(45) Date of Patent: Feb. 16, 2021

(54) METHOD FOR PROCESSING IMAGE DATA WITH ENHANCED GRAYSCALE LEVEL FOR DISPLAY PANEL

(71) Applicants: BEIJING BOE OPTOELECTRONICS TECHNOLOGY CO., LTD., Beijing (CN); BOE Technology Group Co., Ltd., Beijing (CN)

(72) Inventors: Lin Lin, Beijing (CN); Jian Sun, Beijing (CN); Ziqiang Guo, Beijing (CN)

(73) Assignees: BEIJING BOE OPTOELECTRONICS TECHNOLOGY CO., LTD., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/626,804

(22) PCT Filed: May 4, 2018

(86) PCT No.: PCT/CN2018/085603
§ 371 (c)(1),
(2) Date: Dec. 26, 2019

(87) PCT Pub. No.: WO2019/210508
PCT Pub. Date: Nov. 7, 2019

(65) Prior Publication Data
US 2020/0118479 A1 Apr. 16, 2020

(51) Int. Cl.
*G09G 3/20* (2006.01)
*G09G 3/36* (2006.01)
*G09G 5/02* (2006.01)

(52) U.S. Cl.
CPC ..... *G09G 3/2025* (2013.01); *G09G 3/2003* (2013.01); *G09G 3/2077* (2013.01);
(Continued)

(58) Field of Classification Search
CPC ..... G09G 2320/0233; G09G 3/3607; G09G 3/2003; G09G 2310/027;
(Continued)

(56) References Cited

U.S. PATENT DOCUMENTS 7,209,142 B1 4/2007 Agano
2003/0184569 A1 10/2003 Koga et al.
(Continued)

FOREIGN PATENT DOCUMENTS

CN 101533617 A 9/2009
CN 105096800 A 11/2015

OTHER PUBLICATIONS

International Search Report & Written Opinion dated Jan. 30, 2019, regarding PCT/CN2018/085603.

*Primary Examiner* — Koosha Sharifi-Tafreshi
(74) *Attorney, Agent, or Firm* — Intellectual Valley Law, P.C.

(57) ABSTRACT

The present application discloses a method for processing image data with enhanced grayscale level for a display panel. The method includes receiving image data with a maximum grayscale level up to (M+N)-bit. The method further includes dividing the image data of the (M+N)-bit to a first set of data including low-order part up to M-bit and a second set of data including high-order part up to N-bit. Additionally, the method includes reconstructing multiple sets of new image data up to N-bit based on the first set of data and the second set of data. Furthermore, the method includes forwarding the multiple sets of new image data to the driver circuit respectively in multiple divisional time
(Continued)

periods and driving the display panel to display image using the multiple sets of new image data.

20 Claims, 7 Drawing Sheets

(52) U.S. Cl.
CPC ..... *G09G 3/3648* (2013.01); *G09G 5/028* (2013.01); *G09G 2320/0242* (2013.01)

(58) Field of Classification Search
CPC ... G09G 2320/0673; G09G 2320/0693; G09G 2360/16; G09G 2320/0276; G09G 2320/0626; G09G 3/2007; G09G 3/2025; G09G 3/2077; G09G 3/3648; G09G 2320/0242
USPC ..... 345/89, 690
See application file for complete search history.

(56) References Cited

U.S. PATENT DOCUMENTS

2009/0231365 A1 9/2009 Yin
2010/0110301 A1* 5/2010 Ota ..... G09G 5/006 348/671
2012/0069030 A1* 3/2012 Shang ..... G06F 13/14 345/520

* cited by examiner

METHOD FOR PROCESSING IMAGE DATA WITH ENHANCED GRAYSCALE LEVEL FOR DISPLAY PANEL

CROSS-REFERENCE TO RELATED APPLICATION

This application is a national stage application under 35 U.S.C. § 371 of International Application No. PCT/CN2018/085603 filed May 4, 2018, the contents of which are incorporated by reference in the entirety.

TECHNICAL FIELD

The present invention relates to display technology, more particularly, to a method of processing image data with enhanced grayscale level for displaying image on a display panel, a processor that implements the method, and a display apparatus having the same.

BACKGROUND

A display panel, for example a liquid-crystal display (LCD) panel, includes at least a timing controller and a driver circuit. The tuning controller is configured to convert the image data to a format that meets timing requirement of the driver circuit. The driver circuit selectively controls each subpixel brightness (or grayscale level) to display a certain image based on a driving signal provided from the timing controller. Accordingly, the grayscale level of the display panel is limited by the chip adopted in the driver circuit. A conventional driving chip has maximum data bandwidth of 12-bit, which normally yields grayscale levels up to 4096 for the image displayed by the display panel.

Normally, in order to increase grayscale levels of the image displayed on the display panel, the data bandwidth of the driving chip must be increased, which requires that the chip must transmit data with faster rate. While the data bandwidth is limited by the (transistor) circuit integration on the chip and is determined by overall development of semiconductor technology. Therefore, simple request on increasing the data bandwidth is translated to high dependency on higher-density of circuit integration or increasing number of digital to analog converters or larger chip area which results directly to higher cost in making the driving chip.

SUMMARY

In an aspect, the present disclosure provides a method for processing image data with enhanced grayscale level for a display panel. The method includes receiving image data with (M+N)-bit maximum grayscale level. Additionally, the method includes dividing the image data of the (M+N)-bit to a first set of data with M-bit and a second set of data with N-bit. The method further includes reconstructing K sets of new image data with grayscale levels up to N-bit based on the first set of data and the second set of data. Furthermore, the method includes forwarding the K sets of new image data to a driver circuit respectively in corresponding K divisional time periods defined by a timing controller. Moreover, the method includes driving the display panel to display image in the corresponding K divisional time periods respectively using the K sets of new image data. M is an integer equal to or greater than 2. N is an integer equal to or greater than 8, K is equal to $2^M$. M is less than N.

Optionally, the first set of data includes low-order part M-bit data of the image data with (M+N)-bit and the second set of data includes high-order part N-bit data of the image data with (M+N)-bit.

Optionally, the N-bit is selected from 8-bit, 10-bit, and 12-bit, and M is equal to 2.

Optionally, the first set of data includes three first subsets of data respectively for a subpixel of a first color, a subpixel of a second color, and a subpixel of a third color. Each of the three first subsets of data includes 0, 1, 2, and 3.

Optionally, the second set of data includes three second subsets of data respectively for the subpixel of the first color, the subpixel of the second color, and the subpixel of the third color. Each of the three second subsets of data includes grayscale values up to $2^N$ equal to 256, 1024, and 4096 respectively for the driver circuit for the display panel capable of handling 8-bit, 10-bit, and 12-bit of image data.

Optionally, the reconstructing the K sets of new image data includes setting one of the three second subsets of data as a same base for each of the K sets of new image data for one of the subpixel of the first color, the subpixel of the second color, and the subpixel of the third color; determining K adjustments respectively for the K sets of new image data from the three first subsets of data; and adding the K adjustments to the same base to obtain the K sets of new image data.

Optionally, the determining the K adjustments includes breaking each of three first subsets of data up to M-bit to K elements with values of sub-M-bit data, limiting a sum of the K elements equal to a value of M-bit data, and redistributing the K elements into one row of a three-row matrix.

Optionally, the redistributing the K elements further includes shuffling elements in each row of the three-row matrix to achieve optimal element diversities thereof to have one or more optimal combinations of the K elements, and selecting the K elements in the one or more optimal combinations to be respective K adjustments.

Optionally, the reconstructing the K sets of new image data includes selecting $K=2^2=4$ sets of new image data separately being sent from the driver circuit to the display panel via 4 lanes of the timing controller under Mobile Industry Processor Interface (MIPI) display serial interface.

In another aspect, the present disclosure provides a display apparatus including a display panel, a driver circuit for driving image display on the display panel, and a timing controller coupled to the driver circuit. The timing controller is configured to receive image data with a maximum grayscale level up to (M+N)-bit. Additionally, the timing controller is configured to divide the image data to a first set of data with M-bit and a second set of data with N-bit. The timing controller is further configured to reconstruct K sets of new image data with grayscale levels up to N-bit based on the first set of data and the second set of data. Furthermore, the timing controller is configured to forward the K sets of new image data to the driver circuit respectively in corresponding K divisional time periods defined by the timing controller of the display panel. M is an integer equal to or greater than 2. N is an integer equal to or greater than 8, K is equal to $2^M$. M is less than N.

Optionally, the first set of data includes low-order part M-bit data of the image data with (M+N)-bit, and the second set of data includes high-order part N-bit data of the image data with (M+N)-bit.

Optionally, the N-bit is selected from 8-bit, 10-bit, and 12-bit, and M is equal to 2.

Optionally, the first set of data includes three first subsets of data respectively for a subpixel of a first color, a subpixel of a second color, and a subpixel of a third color. Each first subset of data includes 0, 1, 2, and 3.

Optionally, the second set of data includes three second subsets of data respectively for the subpixel of the first color, the subpixel of the second color, and the subpixel of the third color. Each second subset of data includes grayscale values up to $2^N$ equal to 256, 1024, and 4096 respectively for the driver circuit for the display panel capable of handling 8-bit, 10-bit, and 12-bit of image data.

Optionally, the timing controller is configured to reconstruct the K sets of new image data by setting one of the three second subsets of data as a same base for each of the K sets of new image data for one of the subpixel of the first color, the subpixel of the second color, and the subpixel of the third color. Further, the timing controller is configured to reconstruct the K sets of new image data by determining K adjustments respectively for the K sets anew image data from the three first subsets of data. Furthermore, the timing controller is configured to reconstruct the K sets of new image data by adding the K adjustments to the same base to obtain the K sets of new image data.

Optionally, each of the K adjustments includes one of K elements of sub-M-bit as an additive constitution of a value of M-bit associated with each of three first subsets of data, the K elements being assigned to corresponding K spatial locations in one row of a three-row matrix.

Optionally, the display apparatus further includes one or more selectors configured to shuffle the K elements in each row of the three-row matrix to achieve optimal element diversities thereof to have one or more optimal combinations of the K elements, and to select the K elements in the one or more optimal combinations to be respective K adjustments.

Optionally, the K sets of new image data includes $K=2^2=4$ sets of new image data separately being sent from the driver circuit to the display panel via 4 lanes of the timing controller under Mobile Industry Processor Interface (MIPI) display serial interface.

For the display apparatus described herein, where the driver circuit coupled to the timing controller is configured to receive four sets of new image data of N-bit generated by the timing controller based on image data of (N+2)-bit via four lanes in a time period. In an example, the four sets of new image data of N-bit are sent via four lanes in four divisional time periods. As a result, the transmission rate of the image data in each lane is four times of a normal rate. The display panel is configured to use the four sets of new image data to display image in the normal rate.

Optionally, the display panel is a LCD panel configured to handle image data of N=8, 10, or 12-bit.

In yet another aspect, the present disclosure provides a non-transitory tangible computer-readable storage medium storing computer-readable instructions. The computer-readable instructions are executable by a processor to cause the processor to perform receiving image data with a maximum grayscale level up to (M+N)-bit for a display panel. Additionally, the computer-readable instructions are executable by a processor to cause the processor to perform dividing the image data of (M+N)-bit to a first set of data including low-order part with M-bit and a second set of data including high-order part up to N-bit.

Furthermore, the computer-readable instructions are executable by a processor to cause the processor to perform reconstructing $K=2^M$ sets of new image data up to N-bit based on the first set of data and the second set of data. Moreover, the computer-readable instructions are executable by a processor to cause the processor to perform forwarding K sets of new image data to the driver circuit respectively in corresponding K divisional time periods defined by a timing controller of the display panel.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

A display panel includes mainly a timing controller and a driver circuit. The timing controller is configured to convert the image data to a format that meets timing requirement of the driver circuit. The driver circuit is configured to selectively control each subpixel brightness (or grayscale level) to display an image based on a driving signal provided from the timing controller based on the image data. Accordingly, the maximum grayscale level that can be achieved by the display panel is limited by IC chip adopted by the driver circuit of the display panel. Normally, existing IC chip for the driver circuit has a 12-bit capacity of data bandwidth, yielding grayscale levels up to 4096 for the image displayed by the display panel. For displaying image with higher grayscale levels, the data bandwidth must be increased in the corresponding IC chip for the driver circuit. This demands higher bit-rate for transferring data through the driver circuit for driving the display panel. Higher bit-rate for IC chip means a requirement of forming more DAC/ADC circuits on the IC chip with higher integration density. This requires either building the driver circuit on larger chip area or relying on design with high integration density or high-level processing technology, all leading to much higher cost for integrating the driver circuit on the IC chip.

Figure 1:
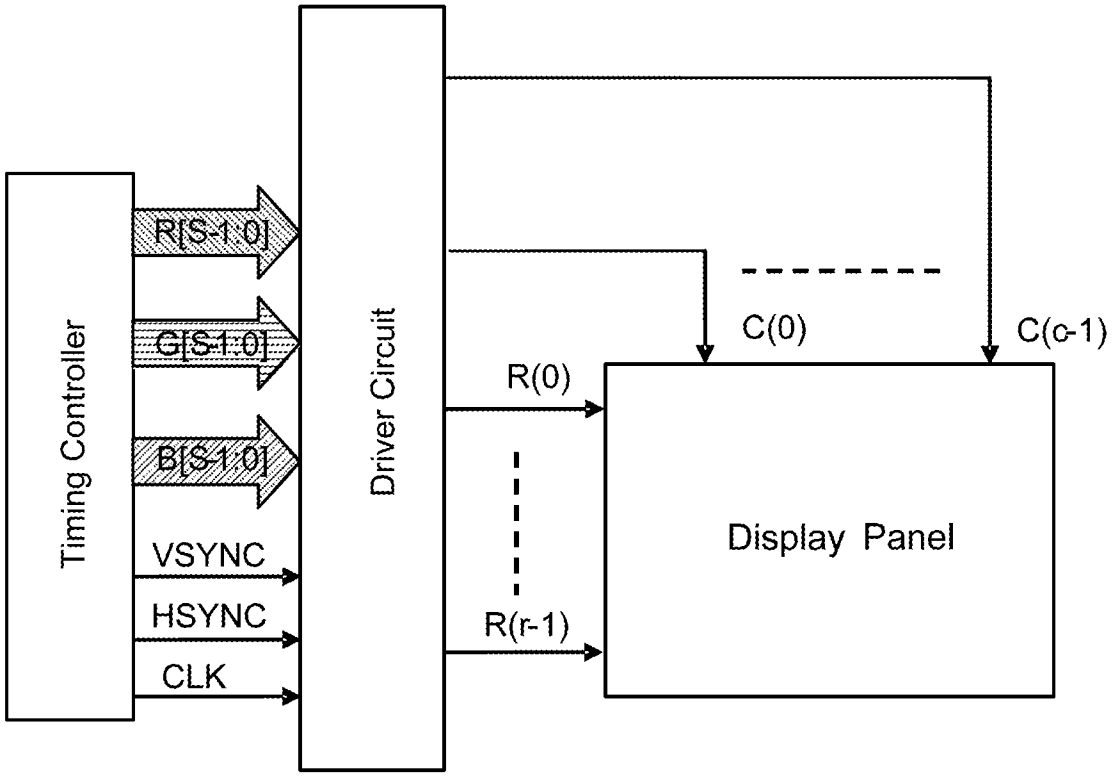
FIG. 1 (prior art)
FIG. 1 is a display control scheme of a display panel using a conventional method for displaying an image with image data having a maximum grayscale level S.

FIG. 1 is a display control scheme of a display panel using a conventional method for displaying an image with image data having a maximum grayscale level S. The timing controller is configured to convert the image data to a format that meets timing requirement of the driver circuit. The driver circuit selectively controls each subpixel brightness (or grayscale level) to display a certain image based on data signals R(0), . . . , R(r−1) and controlled by driving signals C(0), . . . , C(c−1) provided from the timing controller. A typical driver circuit can handle 12-bit data for defining the maximum grayscale level up to S=4096. Most existing methods of increasing number of display grayscale level need to increase data processing bandwidth of the driver circuit or to improve display panel processes with high cost. A method of directly processing image data with enhanced grayscale level for image display without changing process of display panel and increasing data bandwidth of driving chip is desired.

Accordingly, the present disclosure provides, inter alia, a method for processing image data with enhanced grayscale level for a display panel, a display apparatus, and non-transitory tangible computer-readable storage medium that substantially obviate one or more of the problems due to limitations and disadvantages of the related art. In one aspect, the present disclosure provides a method for processing image data with enhanced grayscale level for a display panel. Optionally, the method is applicable to but not limited to a liquid crystal display (LCD) panel or an Organic Light-Emitting Diode (OLED) display panel. In some embodiments, the method includes receiving image data with a maximum grayscale level up to (M+N)-bit, i.e., M-bit higher than a regular maximum grayscale level of N-bit used by a driver circuit of the display panel: dividing the image data of (M+N)-bit to a first set of data containing low-order part up to M-bit and a second set of data containing high-order part up to N-bit; reconstructing K sets of new image data with grayscale levels up to N-bit based on the first set of data and the second set of data; forwarding the K sets of new image data to the driver circuit respectively in corresponding K divisional time periods defined by a timing controller of the display panel; and driving the display panel to display image in the K divisional time periods respectively using the K sets of new image data. Optionally, M is an integer equal to or greater than 2, N is an integer equal to or greater than 8, K is equal to $2^M$, and M is less than N. Typically, a maximum grayscale level can be handled in existing display panel is 8-bit, 10-bit, or 12-bit (i.e., N=8, 10, or 12). For example, one of a 14-bit data, 111 . . . 11101, is received. The high-order part with 12-bit of the 14-bit data is 111 . . . 111. The low-order part 2-bit data is 01, or simply with value 1. That is: M=2, N=12. Other low-order part 2-bit data includes 00, 01, 10, 11, corresponding to values of 0, 1, 2, and 3, respectively.

In the embodiment, the method is to use existing display panel with maximum data bandwidth of handling grayscale level up to N-bit to display image with enhanced grayscale level of (M+N)-bit. The step of dividing the image data of the method is to obtain the second set of data with grayscale levels up to the high-order part N-bit data of the (M+N)-bit data as a base data. In order to substantially fully characterize the enhanced grayscale level of (M+N)-bit image data using the N-bit base data, it needs at least $K=2^M$ variations of the base data that correspond to the image data intended for displaying the image with enhanced grayscale level of (M+N)-bit. So, the step of dividing the image data is also to obtain the first set of data with low-order part of M-bit for deducing adjustments to provide necessary variations of the base data. Thus, the step of reconstructing K sets of new image data is to generate the new image data. Firstly, the new image data are N-bit data that is able to be handled by the existing driver. Secondly, the new image data includes $K=2^M$ sets of variations for substantially providing full characteristics of enhanced grayscale levels of (M+N)-bit to the image displayed by the display panel.

In the embodiment, the K sets of new image data are directly generated based on the first set of data up to M-bit and the second set of data up to N-bit obtained in the step of dividing the original image data. The first set of data includes three first subsets of data of M-bit associated with a subpixel of a first color (e.g., red), a subpixel of a second color (e.g., green), and a subpixel of a third color (e.g., blue). The second set, of data includes three second subsets of data of N-bit respectively associated with the subpixel of the first color, the subpixel of the second color, and the subpixel of the third color. In particular, the step of reconstructing the K sets of new image data includes setting one of the three second subsets of data as a same base for each of the K sets of new image data associated with the first color, the the second color, and the third color. Then, the step further includes determining K adjustments respectively for the K sets of new image data from the three first subsets of data and adding the K adjustments to the same base to obtain the K sets of new image data. Here, K must be equal to $2^M$. For example, M=2, then $K=2^2=4$. 4 variations of N-bit data may possibly produce image display effect of the image data of (N+2)-bit. If M=3, then K must be $2^3=8$. For typical existing display panel, a timing controller associated with the display panel has a built-in capability of handling four variations of the data at a time by design based on MIPI specification for the display panel. Thus, typically, K is chosen to be 4 and accordingly, M is 2.

In the embodiment, the step of determining K adjustments is executed by breaking each of three first subsets of data with M-bit to K elements of sub-M-bit with a limitation that a sum of the K elements is equal to the value of the M-bit data. For example, a 2-bit data value is 3 and K=4 elements can be 1, 1, 1, 0 with a sum of 1+1+1+0=3. The step further includes redistributing the K elements into one row of a three-row matrix. Additionally, the step of redistributing the K elements is executed by shuffling the elements in each row of the three-row matrix to achieve optimal element diversities thereof to have one or more optimal combinations of the K elements, and selecting the K elements in the one or more optimal combinations to be respective K adjustments. In a specific implementation of the method, the optimal element diversities can be achieved in more than one combination of the K elements while effectively, the K adjustments based on the selected. K elements with the optimal combination can be added to the base data respectively to produce necessary variations of the K sets of new image data.

In the embodiment, the method further includes forwarding the K sets of new image data to the driver circuit respectively in corresponding K divisional time periods defined by the timing controller of the display panel. For the existing display panel, the timing controller has a built-in four lanes under MIPI display serial interface (DSI) specification that can transfer data in time-divisional manner Thus, typically, K is chosen to be 4 and the four sets of new image data are separately forwarded to the driver circuit via the 4 lanes of the DSI interface in four divisional time periods per one display cycle (for one frame of image). The display panel then can be driven by the driver circuit to use the K=4 sets of new image data to display image in the four divisional time periods. Since $K=2^M$, accordingly, M is 2. For advanced display panel, if the timing controller has more built-in selectors for handling selections of more elements out of the grayscale level up to 3-bit with capability of 8 lanes for transferring data in 8 divisional time periods, the K can be 8 and M can be 3. Below, examples in description and figures for illustrating the invention are only provided using M=2 and N=12.

Figure 2:
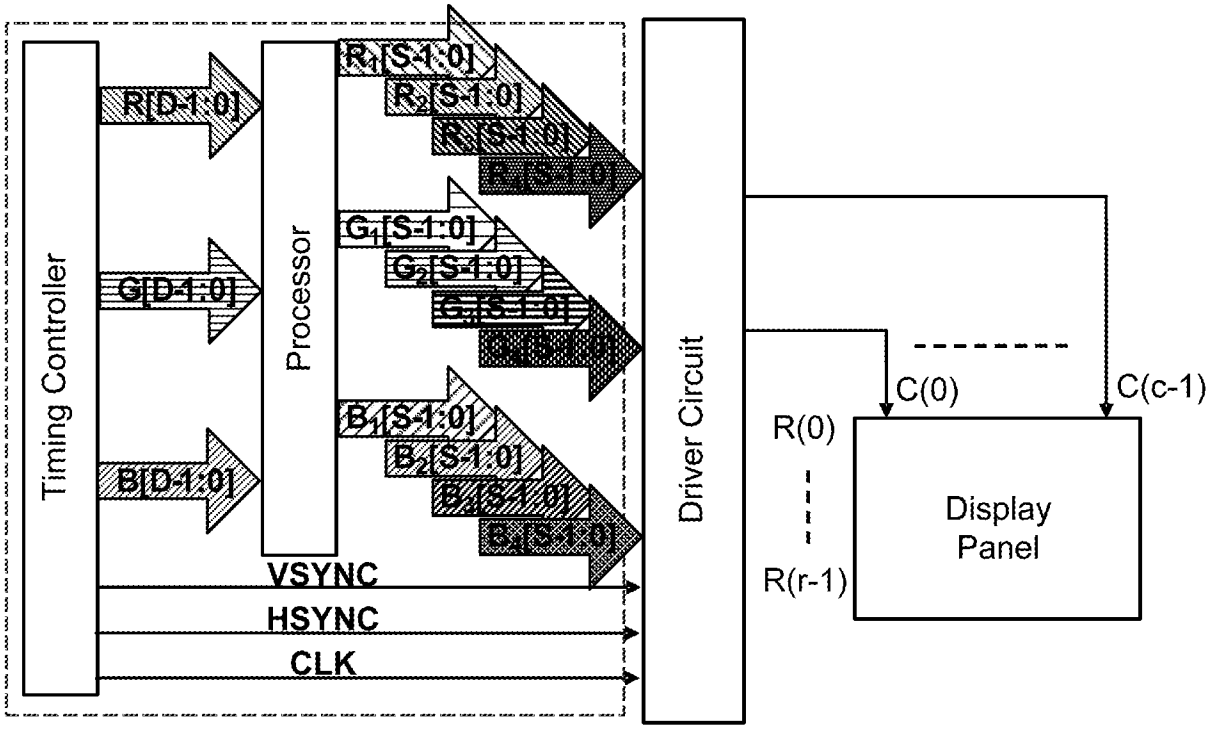
FIG. 2 is a display control scheme of a display panel using an improved method for displaying an image with image data having an enhanced maximum grayscale level D (D>S) according to some embodiments of the present disclosure.

In one aspect, the present disclosure provides a method of processing image data with enhanced grayscale level for displaying image on a display panel. FIG. 2 is a display control scheme of a display panel using an improved method for displaying an image with image data having an enhanced maximum grayscale level D (D>S) according to some embodiments of the present disclosure. Referring to FIG. 2, the timing controller is configured to receive image data having an enhanced maximum grayscale level D (D>S). Optionally, the image data can be represented by three sets of data signals R[D-1:0], G[D-1:0], and B[D-1:0] respectively for determining image brightness of red (R) subpixels, green (G) subpixels, and blue (B) subpixels of the display panel. Optionally, the maximum grayscale level D is up to 2-bit higher than regular maximum grayscale level S that can be handled by the driver circuit with designed data bandwidth of N-bit. In an example, the enhanced grayscale level of image data received is 14-bit or 2-bit higher than maximum grayscale level for image data regularly being handled by a display panel. Thus, N=12, $S=2^N=2^{12}=4096$ and $D=2^{N+2}=2^{14}=16384$ for implementing the method for enhancing grayscale levels to 14-bit. Optionally, for a display panel configured to handle maximum grayscale level of 10-bit, i.e., N=10, the method described herein can be executed to enhance the maximum grayscale level to 12-bit. Optionally, for a display panel configured to handle maximum grayscale level of 8-bit, i.e., N=8, the method described herein can be executed to enhance the maximum grayscale level to 10-bit.

In the embodiment, instead of directly forwarding these image data from the timing controller to the driver circuit, a processor of the timing controller is configured to perform a step of the method for dividing the image data $D_{XN+2}$ to a first set of data $L_{X2}$ with grayscale levels up to 2-bit and a second set of data $M_{XN}$ with grayscale levels of 3-bit and higher up to N-bit. In particular, this step is performed for each of the three sets of data signals R[D-1:0], G[D-1:0], and 13[D-1:0] for three colors subpixels. X stands for each of R, G, and B three colors. Therefore, the first set of data $L_{X2}$ in fact includes three subsets of data $L_{R2}$, $L_{G2}$, and $L_{B2}$. Similarly, the second set of data $M_{XN}$ also includes three subsets of data $M_{RN}$, $M_{GN}$, and $M_{BN}$.

Figure 3:
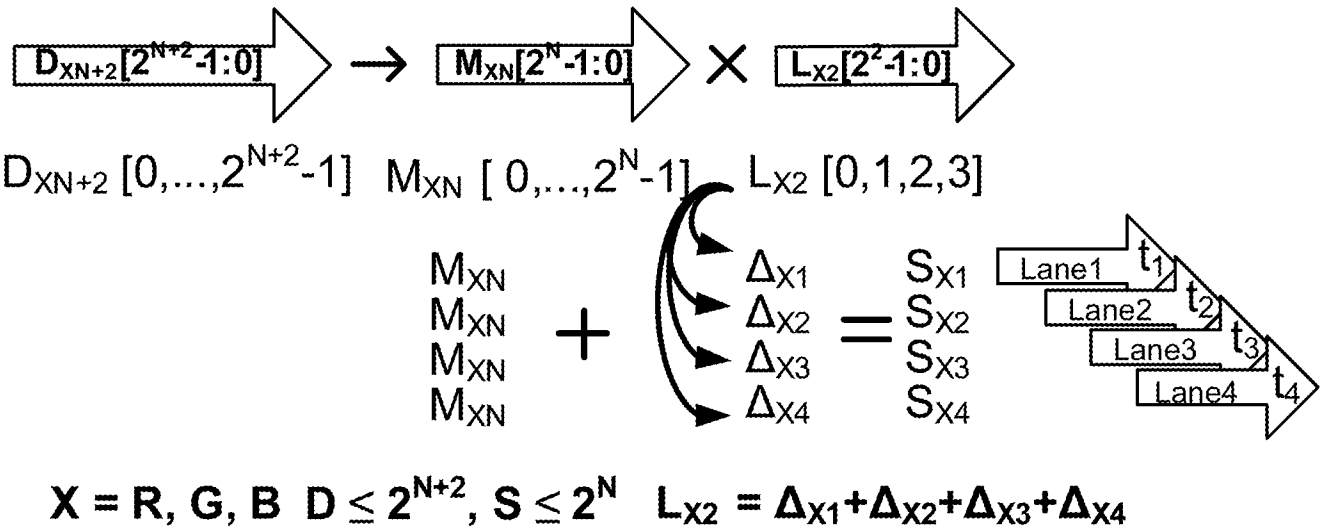
FIG. 3 is a schematic diagram illustrating a method of processing image data with maximum grayscale level D to reconstruct four sets of new image data with maximum grayscale level S for displaying image in four divisional time periods according to an embodiment of the disclosure.

FIG. 3 is a schematic diagram illustrating a method of processing image data with maximum grayscale level D to reconstruct four sets of new image data with maximum grayscale level S for displaying image in four divisional time periods according to the embodiment of the disclosure. Referring to FIG. 3, the image data with maximum grayscale level of N+2-bit for X color is represented by $D_{XN+2}$ is selected from 0, 1, . . . , and $2^{N+2}$-1. The first set of data $L_{X2}$ obtained by dividing the image data of (N+2)-bit is a low-order part 2-bit data, i.e., optionally a value of $L_{X2}$ is selected from 0, 1, 2, and 3. The second set of data $M_{XN}$ obtained by dividing the image data (N+2)-bit is a high-order part N-bit data, i.e., a value of $M_{XN}$ is selected from 0, 1, . . . , and $2^N$-1. Again, X stands for each of R, G, and B three colors.

Referring to FIG. 3, the method further includes reconstructing multiple sets of new image data $S_{Xn}$ with grayscale levels up to N-bit based on the first set of data $L_{X2}$ and the second set of data $M_{XN}$. Optionally, the multiple sets of new image data $S_{Xn}$ include four sets of data, i.e, n=1, 2, 3, 4 and X stands for each of R, G, and B three colors. Each set of the new image data (for each color) has a maximum grayscale level up to N-bit. In the embodiment, the four sets of data $S_{Xn}$ are reconstructed by the processor and designed to be forwarded from the driver circuit to the display panel in four divisional time periods t1, t2, t3, and t4 configured intrinsically by the timing controller based on standard Mobile Industry Processor Interface (MIPI) Display Serial Interface (DSI) specification. In the timing controller, four lanes are configured under the MIPI display serial interface to send four sets of data respectively in four divisional time periods. In one example, each set of data $S_{Xn}$ is transmitted in each of the four lanes by the timing controller. As a result, the transmission rate of the image data is four times of a normal rate originally set for transmitting one set of N-bit image data.

Referring to FIG. 3, in particular, the reconstructing the four sets of new image data $S_{X1}$, $S_{X2}$, $S_{X3}$, and $S_{X4}$ is executed by setting the second set of data $M_{XN}$ to a same base for each of the four sets of new image data and determining four adjustments $\Delta_{X1}$, $\Delta_{X2}$, $\Delta_{X3}$, and $\Delta_{X4}$ from the first set of data $L_{X2}$ respectively to be added to the same base to obtain the four sets of new image data. In an example, the image data with enhanced grayscale level up to 14-bit is divided to a first set of data with low-order part 2-bit data $L_{X2}$ and a second set of data with high-order part 12-bit data $M_{X12}$. As mentioned earlier and shown in FIG. 3, the first set of data $L_{X2}$ has 2-bit with a value selected from 0, 1, 2, 3. Based on the first set of data and the second set of data, four sets of new image data each with grayscale level up to 12-bit are constructed and sent by the timing controller to the driver circuit in respective time period with 4× of normal rate. Using red color data as an example and assuming that the LCD timing controller sends four sets of new red-color data: $S_{R1}$, $S_{R2}$, $S_{R3}$, and $S_{R4}$. When $M_{R12}=2^{12}-1=4095$, only one case: $L_{R2}=0$. Then in this case, every set of new red-color data is just the same base: $S_{R1}=M_{R12}$, $S_{R2}=M_{R12}$, $S_{R3}=M_{R12}$, and $S_{R4}=M_{R12}$, and each of the four adjustments is zero. In other cases when $M_{R12}<4095$, $L_{R2}$ optionally can be selected from 1, 2, and 3. Then there is a plurality of options to select the four adjustments to be added to the base $M_{R12}$. For example, when $L_{R2}=1$, 1) $S_{R1}=M_{R12}+1$, $S_{R2}=M_{R12}$, $S_{R3}=M_{R12}$, and $S_{R4}=M_{R12}$; 2) $S_{R1}=M_{R12}$, $S_{R2}=M_{R12}+1$, $S_{R3}=M_{R12}$, and $S_{R4}=M_{R12}$; 3) $S_{R1}=M_{R12}$, $S_{R2}=M_{R12}$, $S_{R3}=M_{R12}+1$, and $S_{R4}=M_{R12}$, $S_{R1}=M_{R12}$, $S_{R2}=M_{R12}$, $S_{R3}=M_{R12}$, and $S_{R4}=M_{R12}+1$. When $L_{R2}=2$, there are some options of selecting various combinations of four adjustments for $M_{R12}=4094$ and some additional options of selecting various combinations of four adjustments for $M_{R12}<4094$.

Optionally, the determination of the four adjustments is executed by employing one or more selectors in the processor to select either 0 or $L_{X2}$ itself for each adjustment. For example, the four adjustments are 3, 0, 0, and 0. Then the four sets of new image data are: $S_{X1}=M_{XN}+N+3$, $S_{X2}=M_{XN}$, $S_{X3}=M_{XN}$, and $S_{X4}=M_{XN}$, for any color X. Optionally, determining the four adjustments can be executed by employing one or more selectors to firstly break down the 2-bit of the first set of data $L_{X2}$ to four elements $\Delta_{X1}$, $\Delta_{X2}$, $\Delta_{X3}$, and $\Delta_{X4}$ with grayscale level of 1-bit (i.e., 0 or 1) with a limitation that a sum of the four elements $\Delta_{X1}+\Delta_{X2}+\Delta_{X3}+\Delta_{X4}$ equals to $L_{X2}$. For example, $L_{X2}=3$ is broken down to 1, 1, and 1 so the four adjustments can be 1, 1, 1, and 0. The sum of the four elements 1+1+1+0 equals to 3. The four elements $\Delta_{X1}$, $\Delta_{X2}$, $\Delta_{X3}$, and $\Delta_{X4}$ with value of 1-bit are assigned to be four elements in one row of a three-row matrix. This applies for every color X=R, or G, or B so that total three rows of four elements respectively associated with 3 colors are assigned to construct a 3×4 matrix, Dis_array:

$$\text{Dis_Array}=\begin{Bmatrix}\Delta_{R1} & \Delta_{R2} & \Delta_{R3} & \Delta_{R4}\\ \Delta_{G1} & \Delta_{G2} & \Delta_{G3} & \Delta_{G4}\\ \Delta_{B1} & \Delta_{G2} & \Delta_{G3} & \Delta_{G4}\end{Bmatrix}$$

Secondly, the selector associated with the processor can be configured to shuffle the four elements with value of 1-bit in each row of the 3×4 matrix such that the matrix achieves optimal elements diversities. Optionally, such optimal element diversities may be satisfied in one or more combinations of shuffling the four elements, in each of three rows of the three-row matrix. The four adjustments for the four sets of new image data for one of three colors thus can be selected to be the four elements $\Delta_{X1}$, $\Delta_{X2}$, $\Delta_{X3}$, and $\Delta_{X4}$ of corresponding one row of the three-row matrix with optimal elements diversities. By adding the four adjustments to the base, the four sets of new image data $S_{Xn}$ for the corresponding color X are obtained. Each set of new image data has maximum grayscale level of N-bit that the driver circuit is designed to handle for displaying image on the display panel.

Referring to FIG. 3, the method further includes forwarding the four sets of new image data $S_{Xn}$ by the processor via four lanes respectively in 4 divisional time periods determined under the MIPI Display Serial Interface specification of the timing controller to the driver circuit. In particularly, Lane1 of the timing controller sends the first set of new image data $S_{X1}$ in a first time period t1 of the four divisional time periods. Lane2 sends the second set of new image data $S_{X2}$ in the second period t2. Lane3 sends the third set of new image data $S_{X3}$ in the third time period t3. Finally, Lane4 sends the fourth set of new image data $S_{X4}$ in the fourth time period t4. In each of the four divisional time periods, the driver circuit is able to use corresponding one of the four sets of the new image data $S_{Xn}$ to drive the display panel to display an image. To the display panel, in each divisional time period the image data it handled is N-bit data. To a viewer, in each cycle time (including the total four divisional time periods) an image characterized by image data with enhanced grayscale level up to (N+2)-bit is effectively displayed. Effectively, this increases the grayscale levels displayed by existing display panel by 4 times. For example, normal display panel can display image with grayscale levels of 12-bit up to 4096. With the implementation of the method disclosed above the same display panel is able to display image with enhanced grayscale levels of 14-bit up to 16384.

Figure 4:
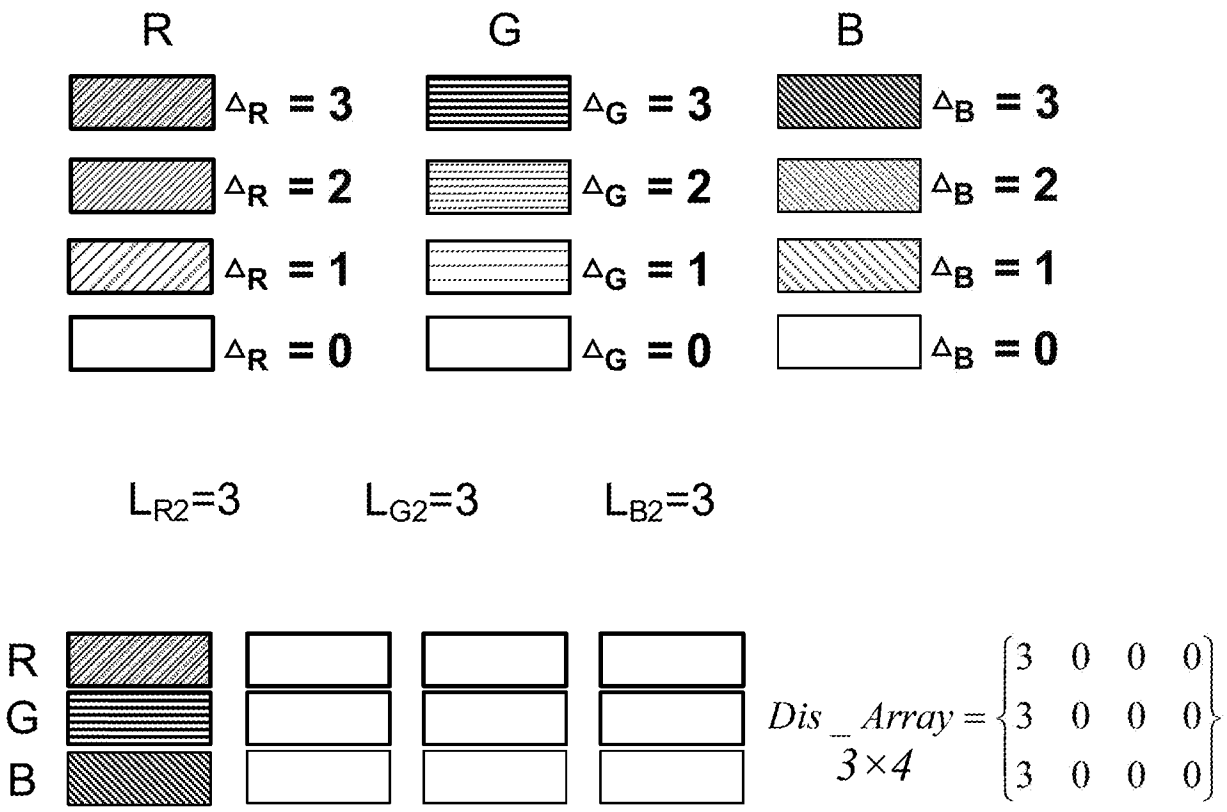
FIG. 4 is a schematic diagram illustrating an exemplary spatial distribution of a first set of data of 2-bit without optimization.

FIG. 4 is a schematic diagram illustrating an exemplary spatial distribution of a first set of data of 2-bit without optimization. As seen in FIG. 3, a first set of data LX, is divided from the image data with enhanced grayscale level D which may be 2-bit higher than a maximum grayscale level of S. Optionally, the first set of data $L_{X2}$ is used to determine four adjustments to be added to a second set of data $M_{XN}$ with maximum grayscale level of N-bit [which is deduced from the high-order N-bit of the (N+2)-bit image data] for reconstructing four sets of new image data. In, the example shown in FIG. 4, for each color X=R, G, and B, the first set of data $L_{X2}$ has 2-bit with a value equal to 3. FIG. 4 correspondingly shows four grayscale levels varied from 3 to 0 for each of three colors: red (R), green (G), and blue (B). Each of the four adjustments of the new image data for each color can be selected from four possible options of the first set of data $L_{X2}$: 3, 2, 1, and 0. While FIG. 4 shows a specific selection of the four adjustments as 3, 0, 0, 0 for each, of the three colors R, G, and B to be assigned to respective three rows of a 3×4 matrix:

$$\text{Dis_Array}=\begin{Bmatrix}3 & 0 & 0 & 0\\ 3 & 0 & 0 & 0\\ 3 & 0 & 0 & 0\end{Bmatrix}$$

However, the above selection is certainly not spatially optimized as the first set of new image data is forced to add a higher grayscale level of 3 out of rest three sets of new image data at a normal grayscale. When the driver circuit uses these new image data to display an image, a viewer may easily capture abnormal color/brightness variation in certain subpixels, which is an undesired situation.

Figure 5:
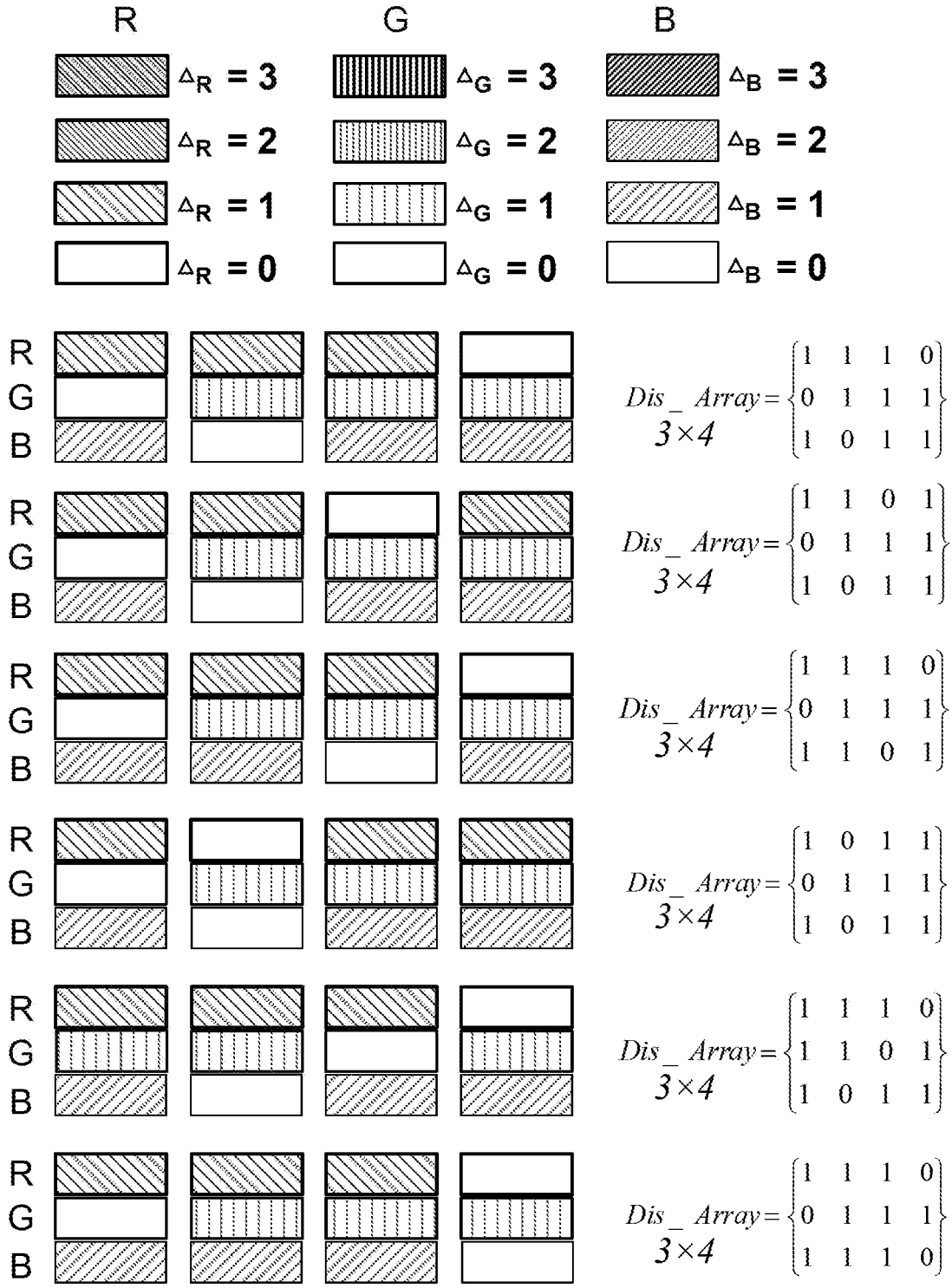
FIG. 5 is a schematic diagram illustrating one or more exemplary spatial distributions with optimal diversities of four elements of I-bit respectively broken down from three subsets of the first set of data of 2-bit according to an embodiment of the present disclosure.

FIG. 5 is a schematic diagram illustrating one or more exemplary spatial distributions with optimal diversities of four elements with value of 1-bit respectively broken down from three subsets of the first set of data of 2-bit according to an embodiment of the present disclosure. Referring to FIG. 4 and FIG. 5, a same scenario with $L_{X2}$ with a value of 3 (i.e., $L_{R2}=3$, $L_{G2}=3$, $L_{B2}=3$) of FIG. 4, in an example, each $L_{X2}=3$ is broken down to several combinations of four elements with grayscale levels at 1, 1, 1, and 0. This is one of preferred division of 3 that yields element diversity. In another option, if the $L_{X2}=3$ is broken down to 2, 1, 0, and 0, the element diversity is poorer and the combination is yet less preferred. In the embodiment, three sets of four elements are obtained respectively for three colors R, G, and B. As the three sets of four elements are assigned to three rows of the 3×4 matrix, the elements in each row can be shuffled in spatial locations to have the matrix elements to achieve optimal element diversities in multiple optional combinations as shown in FIG. 5. Then, the four adjustments $\Delta_{X1}$, $\Delta_{X2}$, $\Delta_{X3}$, and $\Delta_{X4}$ to be added to respective four sets of base data (being the same $M_{R12}$) for each of three colors can be determined or selected from one of the multiple optional combinations of those four elements in corresponding one of three rows out of the multiple optimal three-row matrices.

Figure 6:
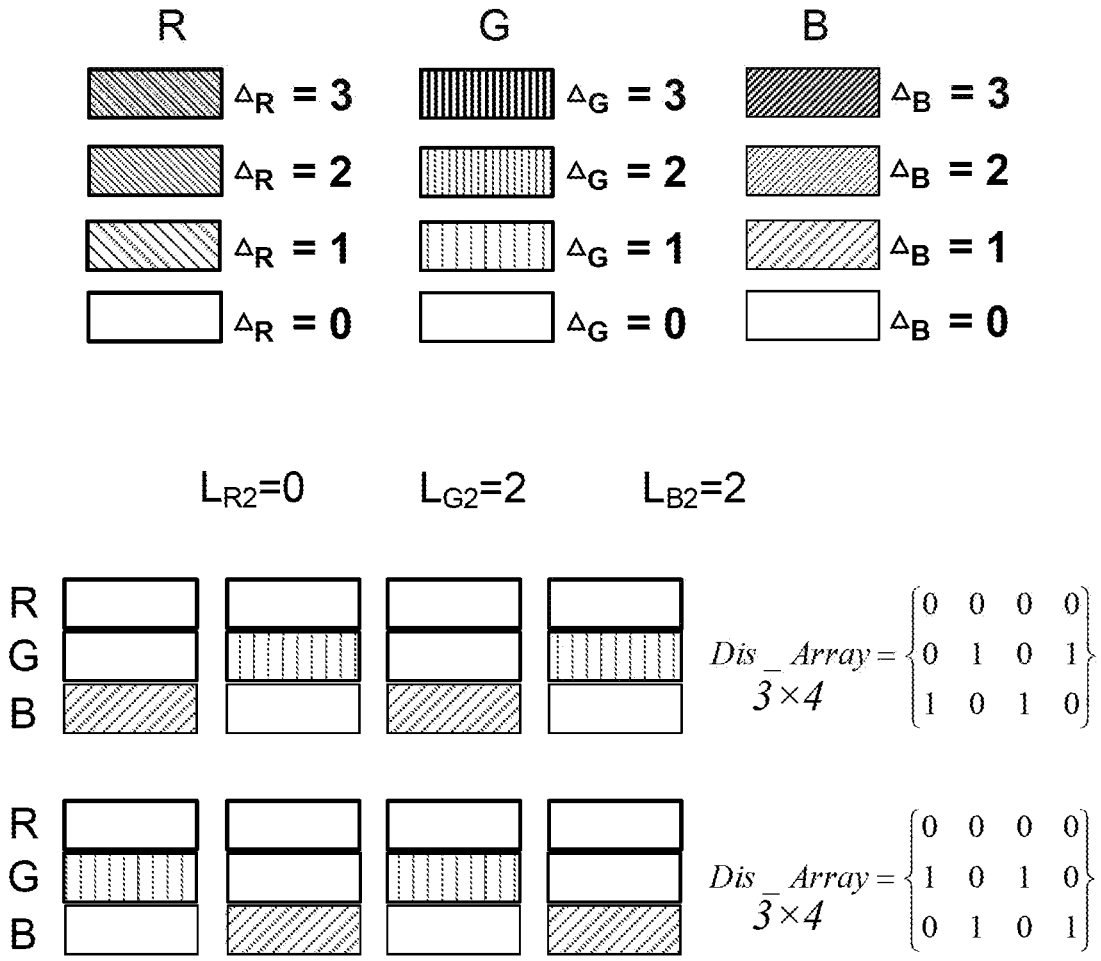
FIG. 6 is a schematic diagram illustrating other exemplary spatial distributions with optimal diversities of four elements of 1-bit respectively broken down from three subsets of the first set of data of 2-bit according to another embodiment of the present disclosure.

FIG. 6 is a schematic diagram illustrating other exemplary spatial distributions with optimal diversities of four elements with value of 1-bit respectively broken down from three subsets of the first set of data of 2-bit according to another embodiment of the present disclosure. In this example, the first set of data for red color $L_{R2}$ is 0, the first set of data for green color $L_{G2}$ is 2, and the first set of data for blue color $L_{B2}$ is 2. Both the $L_{G2}$ and $L_{B2}$ can be broken down to four elements at 1, 0, 1, 0 or 0, 1, 0, 1 to yield optimal element diversity. As shown in FIG. 6, two matrices are shown to achieve overall optimal element diversities for the combinations of the four elements selected in each row. Accordingly, the four adjustments $\Delta_{X1}$, $\Delta_{X2}$, $\Delta_{X3}$, and $\Delta_{X4}$ for constructing four sets of new image data for one of three colors can be selected from the optimal combinations of the four elements in corresponding one of three rows out of the two optimal matrices.

Figure 7:
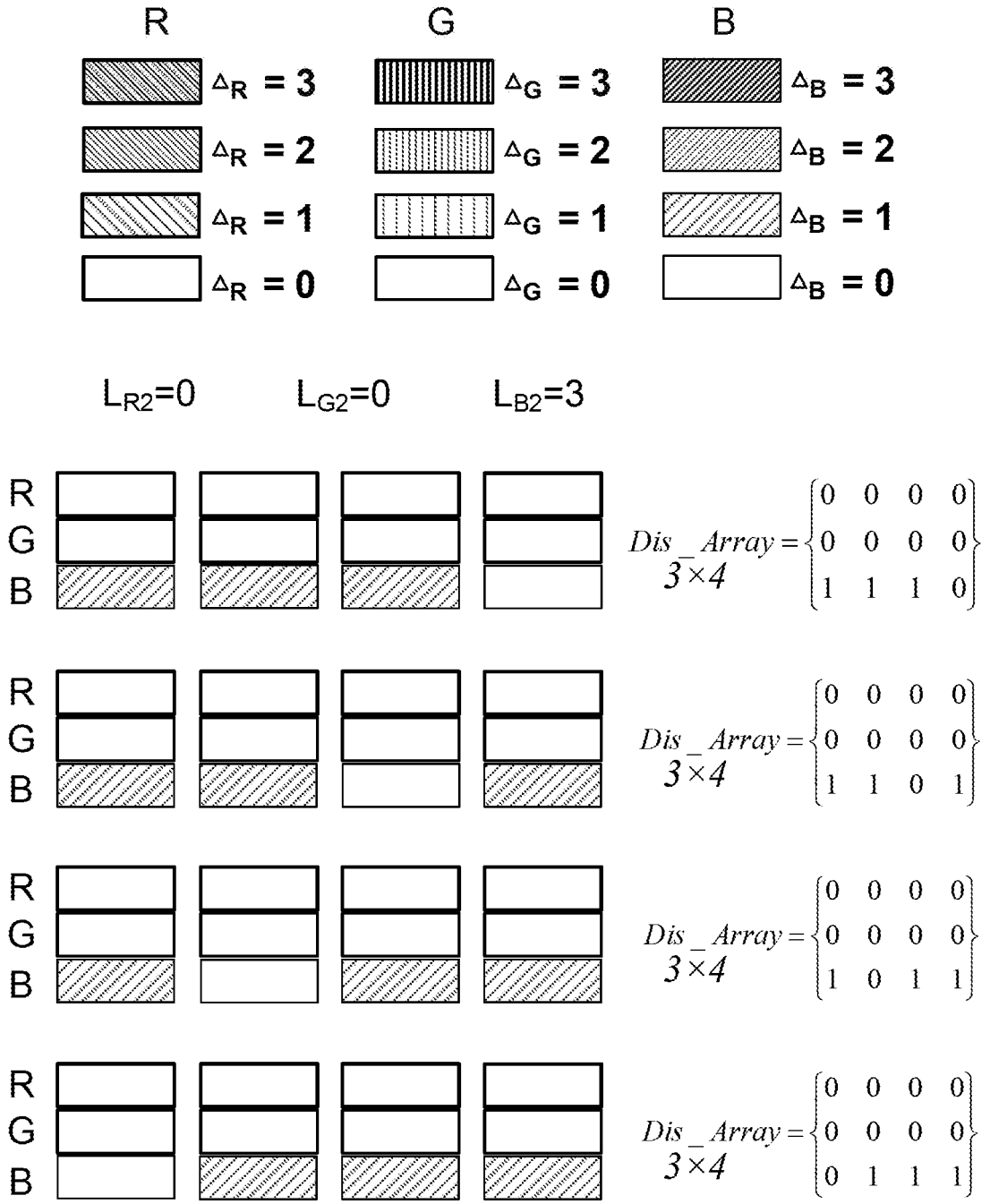
FIG. 7 is a schematic diagram illustrating additional exemplary spatial distributions with optimal diversities of four elements of 1-bit respectively broken down from, three subsets of the first set of data of 2-bit according to yet another embodiment of the present disclosure.

FIG. 7 is a schematic diagram illustrating additional exemplary spatial distributions with optimal diversities of four elements of 1-bit respectively broken down from three subsets of the first set of data of 2-bit according to yet another embodiment of the present disclosure. In yet another example, the first set of data for red color $L_{R2}$ is 0, the first set of data for green color $L_{G2}$ is 0, and the first set of data for blue color $L_{B2}$ is 3. Referring to FIG. 7, the $L_{B2}$ can be broken down to four elements of 1, 1, 1, and 0. At least four optimal combinations of the four elements are resulted in the four matrices with all elements in the first and the second rows being zero. Accordingly, the four adjustments $\Delta_{X1}$, $\Delta_{X2}$, $\Delta_{X3}$, and $\Delta_{X4}$ for constructing four sets of new image data for one of three colors can be selected from the optimal combinations of the four elements in corresponding one of three rows out of the four optimal matrices.

In another aspect, the present disclosure provides a display apparatus having a display panel; a driver circuit for driving image display in the display panel; and a timing controller coupled to the driver circuit. In some embodiments, the timing controller includes a memory; and one or more processors. The memory and the one or more processors are connected with each other. The memory stores computer-executable instructions for controlling the one or more processors to receive image data with a maximum grayscale level up to (M+N)-bit, M-bit higher than a regular maximum grayscale level of N-bit normally handled by the driver circuit of the display panel; divide the image data of (M+N)-bit to a first set of data with low-order part M-bit and a second set of data with high-order part N-bit of the (M+N)-bit data; reconstruct K sets of new image data with grayscale levels up to N-bit based on the first set of data and the second set of data; and forward the K sets of new image data to the driver circuit respectively in corresponding K divisional time periods defined by the timing controller of the display panel. Various appropriate memories may be used in the present apparatus. Examples of appropriate computer readable memories include, but are not limited to, magnetic disk or tape, optical storage media such as compact disk (CD) or DVD (digital versatile disk), flash memory, and other non-transitory media. Optionally, the memory is a non-transitory memory. Optionally, M is an integer equal to or greater than 2, N is an integer equal to or greater than 8, K is equal to $2^M$, and M is less than N.

In some embodiments, the timing controller is configured to receive image data with a maximum grayscale level up to (N+2)-bit, 2-bit higher than a regular maximum grayscale level of N-bit normally handled by the driver circuit of the display panel. Further, the timing controller is configured to divide the image data to a first set of data of 2-bit and a second set of data up to N-bit. Additionally, the timing controller is configured to reconstruct multiple sets of new image data of N-bit based on the first set of data and the second set of data. Furthermore, the timing controller is configured to forward the K sets of new image data to the driver circuit respectively in corresponding multiple divisional time periods defined by the timing controller of the display panel. Once each of the K sets of new image data is sent to the driver circuit, the driver circuit is able to use the new image data of N-bit to display an image on the display panel in a corresponding one time period. When all the K sets of new image data are displayed in fill cycle (transmitted in the time period with a rate of K-times of a normal rate) of one display cycle, the display panel effectively display an image with enhanced grayscale level up to (N+2)-bit.

In the embodiment, the K sets of new image data includes $2^2$=4 sets of new image data that are separately forwarded to the driver circuit in respective four divisional time periods utilizing four lanes under Mobile Industry Processor Interface (MIPI) display serial interface specification provided for the timing controller.

In yet another aspect, the present disclosure provides a display apparatus including a timing controller having the processor described herein. Further, the display apparatus includes a driver circuit coupled to the timing controller to receive the four sets of new image data of N-bit generated by the timing controller based on image data of (N+2)-bit via four lanes in each time period. Additionally, the display apparatus includes a display panel driven by the driver circuit using the four sets of new image data to display image in the respective time period.

Optionally, the display panel is a LCD display panel. Optionally, the driver circuit is configured to drive the display panel using image data with grayscale levels up to 12-bit. The timing controller is configured with 4 lanes under Mobile Industry Processor Interface (MIPI) display serial interface specification to deliver data of 12-bit in four sets respectively in a time period. The timing controller includes the processor encoded with instruction for processing image data with enhanced grayscale levels up to 14-bit to generate four sets of new image data of 12-bit or lower and respectively sends the four sets of new image data to the driver circuit via the 4 lanes. The driver circuit thus drives the display panel to display image using the respective four sets of new image data of 12-bit or lower in the time period to achieve an image characteristics of grayscale levels up to 14-bit.

In another aspect, the present disclosure provides a non-transitory tangible computer-readable storage medium storing computer-readable instructions. In some embodiments, the computer-readable instructions being executable by a processor to cause the processor to perform receiving image data with a maximum grayscale level up to (M+N)-bit or M-bit higher than a regular maximum grayscale level of N-bit normally handled by the driver circuit of the display panel; dividing the image data of (M+N)-bit to a first set of data with low-order part M-bit data and a second set of data with high-order N-bit data of the (M+N)-bit data; reconstructing K sets of new image data with grayscale levels up to N-bit based on the first set of data and the second set of data; and forwarding the K sets of new image data to the driver circuit respectively in corresponding K divisional time periods defined by the timing controller of the display panel. Optionally, M is an integer equal to or greater than 2, N is an integer equal to or greater than 8, K is equal to $2^M$, and M is less than N.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method for processing image data with enhanced grayscale level for a display panel, comprising:

receiving image data with (M+N)-bit maximum grayscale level;

dividing the image data of the (M+N)-bit to a first set of data with M-bit and a second set of data with N-bit;

reconstructing K sets of new image data with grayscale levels up to N-bit based on the first set of data and the second set of data;

forwarding the K sets of new image data to the driver circuit respectively in corresponding K divisional time periods defined by a timing controller; and driving the display panel to display image in the corresponding K divisional time periods respectively using the K sets of new image data;

wherein M is an integer equal to or greater than 2, N is an integer equal to or greater than 8, K is equal to $2^M$, and M is less than N.

2. The method of claim 1, wherein the first set of data includes low-order part M-bit data of the image data with (M+N)-bit, and the second set of data includes high-order part N-bit data of the image data with (M+N)-bit, wherein the N-bit is selected from 8-bit, 10-bit, and 12-bit, and M is equal to 2.

3. The method of claim 2, wherein the first set of data comprises three first subsets of data respectively for a subpixel of a first color, a subpixel of a second color, and a subpixel of a third color; and wherein each of the three first subsets of data comprising 0, 1, 2, and 3.

4. The method of claim 3, wherein the second set of data comprises three second subsets of data respectively for the subpixel of the first color, the subpixel of the second color, and the subpixel of the third color; and wherein each of the three second subsets of data comprising grayscale values up to $2^N$ equal to 256, 1024, and 4096 respectively for the driver circuit for the display panel capable of handling 8-bit, 10-bit, and 12-bit of image data.

5. The method of claim 4, wherein the reconstructing the K sets of new image data comprises setting one of the three second subsets of data as a same base for each of the K sets of new image data for one of the subpixel of the first color, the subpixel of the second color, and the subpixel of the third color; determining K adjustments respectively for the K sets of new image data from the three first subsets of data; and adding the K adjustments to the same base to obtain the K sets of new image data.

6. The method of claim 5, wherein the determining the K adjustments comprises breaking each of three first subsets of data up to M-bit to K elements with values of sub-M-bit data, limiting a sum of the K elements equal to a value of M-bit data, and redistributing the K elements into one row of a three-row matrix.

7. The method of claim 6, wherein the redistributing the K elements further comprises shuffling elements in each row of the three-row matrix to achieve optimal element diversities thereof to have one or more optimal combinations of the K elements, and selecting the K elements in the one or more optimal combinations to be respective K adjustments.

8. The method of claim 1, wherein the reconstructing the K sets of new image data comprises selecting $K=2^2=4$ sets of new image data separately being sent from the driver circuit to the display panel via 4 lanes of the timing controller under Mobile Industry Processor Interface (MIPI) display serial interface.

9. A display apparatus, comprising:

a display panel;

a driver circuit for driving image display on the display panel; and a timing controller coupled to the driver circuit;

wherein the timing controller is configured to:

receive image data with a maximum grayscale level up to (M+N)-bit;

divide the image data to a first set of data with M-bit and a second set of data with N-bit;

reconstruct K sets of new image data with grayscale levels up to N-bit based on the first set of data and the second set of data; and forward the K sets of new image data to the driver circuit respectively in corresponding K divisional time periods defined by the timing controller of the display panel;

wherein M is an integer equal to or greater than 2, N is an integer equal to or greater than 8, K is equal to $2^M$, and M is less than N.

10. The display apparatus of claim 9, wherein the first set of data includes low-order part M-bit data of the image data with (M+N)-bit, and the second set of data includes high-order part N-bit data of the image data with (M+N)-bit.

11. The display apparatus of claim 10, wherein the N-bit is selected from 8-bit, 10-bit, and 12-bit, and M is equal to 2.

12. The display apparatus of claim 10, wherein the first set of data comprises three first subsets of data respectively for a subpixel of a first color, a subpixel of a second color, and a subpixel of a third color; each first subset of data comprising 0, 1, 2, and 3.

13. The display apparatus of claim 12, wherein the second set of data comprises three second subsets of data respectively for the subpixel of the first color, the subpixel of the second color, and the subpixel of the third color; each second subset of data comprising grayscale values up to $2^N$ equal to 256, 1024, and 4096 respectively for the driver circuit for the display panel capable of handling 8-bit, 10-bit, and 12-bit of image data.

14. The display apparatus of claim 13, wherein the timing controller is configured to reconstruct the K sets of new image data by:

setting one of the three second subsets of data as a same base for each of the K sets of new image data for one of the subpixel of the first color, the subpixel of the second color, and the subpixel of the third color;

determining K adjustments respectively for the K sets of new image data from the three first subsets of data; and adding the K adjustments to the same base to obtain the K sets of new image data.

15. The display apparatus of claim 14, wherein each of the K adjustments comprises one of K elements of sub-M-bit as an additive constitute of a value of M-bit associated with each of three first subsets of data, the K elements being assigned to corresponding K spatial locations in one row of a three-row matrix.

16. The display apparatus of claim 15, further comprising one or more selectors configured to shuffle the K elements in each row of the three-row matrix to achieve optimal element diversities thereof to have one or more optimal combinations of the K elements, and to select the K elements in the one or more optimal combinations to be respective K adjustments.

17. The display apparatus of claim 9, wherein the K sets of new image data comprise $K=2^2=4$ sets of new image data separately being sent from the driver circuit to the display panel via 4 lanes of the timing controller under Mobile Industry Processor Interface (MIPI) display serial interface.

18. The display apparatus of claim 9, wherein the driver circuit coupled to the timing controller is configured to receive four sets of new image data of N-bit generated by the timing controller based on image data of (N+2)-bit via four lanes; and the display panel is configured to use the four sets of new image data to display image.

19. The display apparatus of claim 18, wherein the display panel is a LCD panel configured to handle image data of N=8, 10, or 12-bit.

20. A non-transitory tangible computer-readable storage medium storing computer-readable instructions, the computer-readable instructions being executable by a processor to ca use the processor to perform:

receiving image data with a maximum grayscale level up to (M+N)-bit for a display panel;

dividing the image data of (M+N)-bit to a first set of data including low-order part with M-bit and a second set of data including high-order part up to N-bit;

reconstructing $K=2^M$ sets of new image data up to N-bit based on the first set of data and the second set of data; and forwarding K sets of new image data to the driver circuit respectively in corresponding K divisional time periods defined by a timing controller of the display panel;

wherein M is an integer equal to or greater than 2, N is an integer equal to or greater than 8, K is equal to $2^M$, and M is less than N.

* * * * *